United States Patent [19]

Shelley

[11] 4,036,007

[45] July 19, 1977

[54] LIGHT EMITTING DIODE WATCH WITH ACCELERATION RESPONSIVE SWITCH

[76] Inventor: Edwin F. Shelley, 339 Oxford Road, New Rochelle, N.Y. 10804

[21] Appl. No.: 604,193

[22] Filed: Aug. 13, 1975

[51] Int. Cl.[2] ..... G04B 19/30

[52] U.S. Cl. ..... 58/50 R; 58/23 R

[58] Field of Search ..... 58/23 R, 23 BA, 50 R, 58/85.5, 127 R

[56] References Cited

U.S. PATENT DOCUMENTS

| | | | |
|---|---|---|---|
| 3,937,002 | 2/1976 | Van Haaften | 58/50 R |
| 3,948,037 | 4/1976 | Carlone | 58/50 R |

*Primary Examiner*—Robert K. Schaefer
*Assistant Examiner*—Vit W. Miska
*Attorney, Agent, or Firm*—Roy C. Hopgood; John M. Calimafde; Eugene J. Kalil

[57] ABSTRACT

In electronic wrist watches in which figures for the time are displayed by light emitting diodes, and in watches with liquid crystal displays where the display is illuminated by a light emitting diode, it is necessary to have the diodes normally unenergized in order to conserve battery power. A switch must be closed to energize the diodes when the display of time is desired. Since the hand of the wrist on which the watch is worn cannot reach the switch, it is necessary for the wearer of the watch to use his other hand to operate the switch and thus both hands are effectively involved in order to tell the time. This invention provides the watch with an acceleration-responsive switch that permits display of the time by a quick movement of the wrist and without involving any manual operation.

9 Claims, 5 Drawing Figures

LIGHT EMITTING DIODE WATCH WITH ACCELERATION RESPONSIVE SWITCH

BACKGROUND AND SUMMARY OF THE INVENTION

This invention provides an inertia or acceleration-responsive electric switch for closing the circuit from the battery to light emitting diodes of an electronic watch, especially a wrist watch. The switch closes when the watch is moved with a predetermined angular acceleration. In the preferred construction, the switch is oriented in the watch case in such a position that it is responsive to a turning movement of the wrist on which a wrist watch is worn; but not responsive to movement in the direction in which the forearm of the wearer extends or in any direction orthogonal to that direction.

The amount of acceleration necessary to operate the switch depends upon the weight of an inertia element incorporated into the switch and upon a spring or other means by which the switch is normally held in open position. It is desirable that the switch not close too easily because this will result in unintentional closing of the switch and unnecessary use of the battery.

The preferred embodiment of the invention includes elements in the electrical circuit of the watch for preventing the supply of power to the light emitting diodes when the switch closes momentarily for a period of time less than a predetermined minimum. For example, in the preferred construction the switch contact must be maintained for more than one hundredth of a second in order to have power supplied to the light emitting diodes.

Another feature of the preferred embodiment is the use of a buffer between the battery and the display power input to the light emitting electrodes for maintaining a supply of power to the light emitting diodes for a predetermined time after the switch opens. The purpose of this feature is to permit the time display to last long enough so that a person using the watch can reliably determine the time.

One of the outstanding features of the invention is that a person wearing the watch of this invention as a wrist watch can get a time display by a rapid turn of the wrist which is a normal movement not likely to attract attention. In many cases it would be embarrassing for a person to reach over and operate a switch on his wrist watch making it evident to others at a conference that he was wondering about the time.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
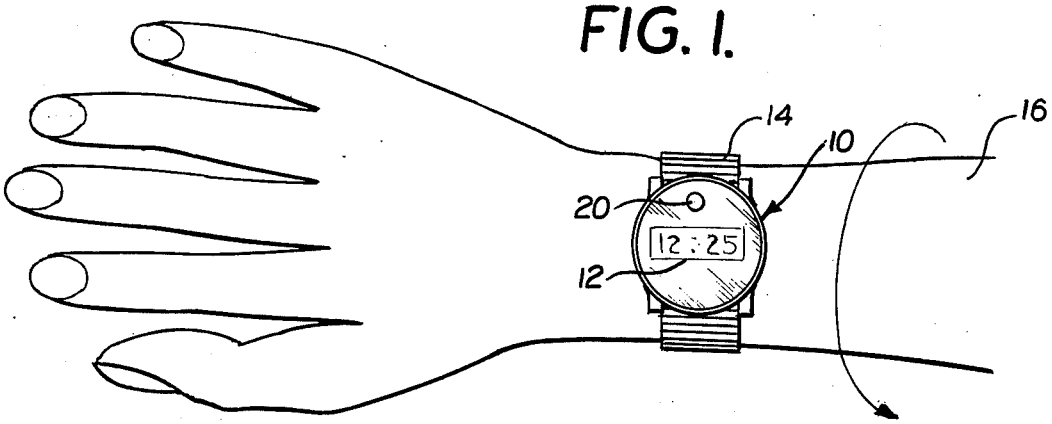
FIG. 1 is a view showing the electronic watch of this invention worn as a wrist watch.

FIG. 1 shows an electronic, digital watch 10 having a face 12 on which numbers indicating the time of day are displayed when light emitting diodes of the watch are energized.

The watch 10 is provided with a strap 14 that passes around a wrist 16 of a person wearing the watch. The watch is oriented with the figures 12 facing upward away from the top of the wearer's wrist in accordance with the conventional way in which a wrist watch is worn.

Figure 2:
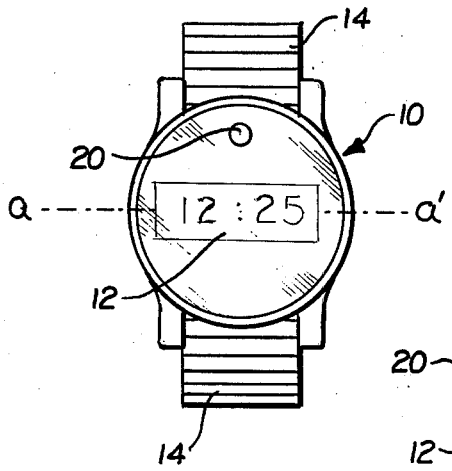
FIG. 2 is a greatly enlarged, fragmentary view of the wrist watch structure shown in FIG. 1.

FIG. 2 shows the watch 10 on an enlarged scale. A switch operating element 20 is located above the watch face 12 and a switch within the watch 10 is closed by pressing the switch operating element 20 to supply power to energize the light emitting diodes of the watch.

Except at such times as the wearer of the watch wants a time display, the switch operating element 20 is held in position, by a spring or other means, which leaves the switch open so as to prevent use of power from the battery which energizes the diodes.

Figure 3:
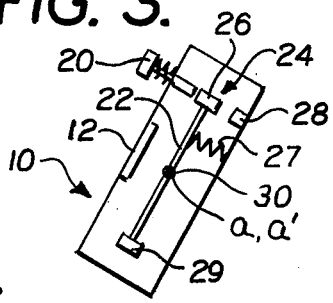
FIG. 3 is a diagrammatic sectional view through the wrist watch shown in FIG. 2, but showing only the acceleration-responsive switch of this invention, other parts of the watch being conventional and not illustrated.

FIG. 3 shows the watch 10 with the switch operating element 20 extending through a front wall of the watch and into contact with an element 22 which is rotatable about an axis a–a′ parallel to the line of numbers displaying the time and which constitutes part of a switch 24 located within the watch.

In addition to the rotatable element, the switch 24 has a movable contact 26 secured to the upper end of the rotatable element 22 in position to touch a fixed contact 28 when the switch operating element 20 is pushed toward the right in FIG. 3, and a spring 27 which normally prevents the switch 24 from closing. A weight 29 at the opposite end of element 22 counterbalances the contact 26 so that linear acceleration will not close the switch 24.

The movable contact 26 is shown in FIG. 3 as being of substantial size and mass so that together with counterweight 29 its inertia causes it to contact with the contact 28 whenever the watch 20 rotates suddenly about the axis a–a′ in a direction which causes the upper part of the watch to move to the left while the lower part moves toward the right in FIG. 3.

The construction described makes the movable contact 26 a part of the inertia element of the switch; but it will be understood that the inertia element and the contact 26 can be made as different parts if desired. For simplicity and economy, the switch 24 that operates by angular acceleration of the watch is the same switch that is operated by the switch operating element 20. It should be understood, however, that the manually operated switch for the watch and the acceleration-operated switch can be separate switches. Where they are the same switch, as shown in FIG. 3, it is desirable to have the switch operating element 20 in a position to displace and close the switch 24 when desired; but at the same time have the switch operating element 20 unconnected with the switch 24 so that the rotatable element 22 and the movable contact 26 can move freely with respect to the fixed contact 28 without moving the switch operating element 20. This leaves the switch 24 freer to respond to angular acceleration of the watch than would be the case if the switch operating element had to move as a unit with the switch 24. Because of its passage through the front wall of the watch 10, or any other wall through which it might pass, the switch operating element 20 involves friction in its movement, whereas the contact 26 secured to the upper end of the rotatable element 22 involves no friction other than inconsequential bearing friction of the rotatable element 22 which is secured by a bearing at its center to a fixed connection 30 inside the watch.

Figure 4:
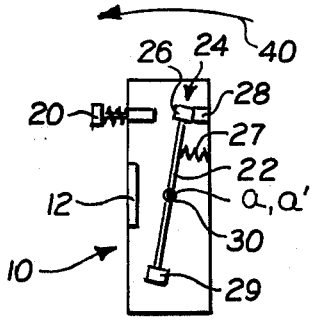
FIG. 4 is a diagrammatic view, similar to FIG. 3, but showing the way in which the switch is closed by movement of the watch.

FIG. 4 shows the watch accelerating in the direction indicated by an arrow 40. This acceleration is sufficient to cause the contacts 26 and 28 to come together so as to close the switch and supply power to the light emitting diodes if the closure of the switch is for more than a predetermined minimum limit as will be explained in connection with FIG. 5.

Figure 5:
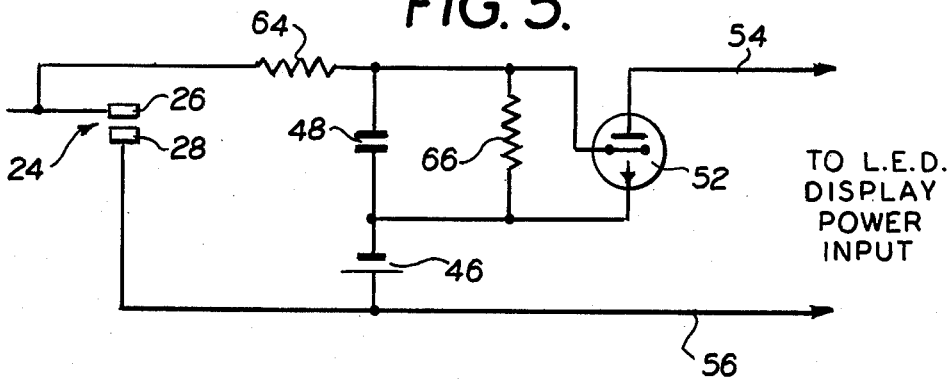
FIG. 5 is a wiring diagram for the novel portion of the watch circuit.

FIG. 5 shows the portion of the circuitry of the watch which involves the novel features of this invention. Switch 24 is connected in series with resistor 64, capacitor 48, and battery 46 which supplies the power for activating the light emitting diodes to display or illuminate the time figures on the face of the watch. The upper terminal of capacitor 48 is connected to the upper terminal of resistor 66 and to one element of the input circuit of transistor 52. The lower terminal of capacitor 48 is connected to the lower terminal of resistor 66 and to the other element of the input circuit of transistor 52. Conductor 54 is connected to the output circuit element of transistor 52 and conductor 56 is connected between battery 46 and contact 28 of switch 24. Conductors 54 and 56 are connected to the light emitting diode display power input circuit in the watch.

Closing of the switch 24 causes the battery 46 to charge the capacitor 48 through the resistor 64. The charge on the capacitor 48 must increase to a predetermined level before there is enough voltage on the transistor 52 to supply power to operate the diodes.

By proportioning the resistance of the resistor 64 with the capacity of the capacitor 48 and the voltage of the battery 46, it is possible to delay the application of an operating voltage to the transistor 52 for a selected period of time. In the preferred embodiment of the invention, the characteristics of the capacitor 48 and the resistor 64 are coordinated so as to delay the operation of the transistor 52 for a period of from one thousandth to one hundredth of a second after the switch 24 closes.

Thus the capacitor 48 and resistor 64, connected in the circuitry as illustrated, provide means for preventing supply of power to the diodes upon momentary contacts of the switch 24 lasting less than one hundredth of a second; this value being given by way of illustration and as a practical value for an acceleration-responsive switch 24 such as disclosed in this specification.

The resistor 66 is connected in parallel with the capacitor 48 and the transistor 52. The electrical characteristics of the resistor 66 and the capacitor 48 are coordinated with the transistor 52 and the diodes, and with each other, so that after the diodes are energized to display or illuminate the figures on the watch face, they will remain energized as the result of the connection of the resistor 66 and the capacitor 48 after the switch 24 has opened.

Thus the capacitor 48 and resistor 66 provide means for maintaining the display of the time figures beyond the opening of the acceleration switch 24. The values of these circuit elements are preferably chosen to give the diodes a minimum time display between one and four seconds, these limits being given by way of illustration and as practical limits for a conventional digital watch having light emitting diodes for showing or illuminating the time signals.

The switch 24 with its contacts 26 and 28 is merely representative of means for opening and closing a circuit in response to accelerating movement of the watch from one position to another and equivalent electrical apparatus for obtaining the same result can be used in place of the switch 24.

The transistor 52 provides a solid state buffer and power control device for the light emitting diode display power input. It is merely representative of other buffers and there are a number of equivalent electrical devices which can be used to obtain the same result as the transistor 52.

It will also be understood that the elements 64 and 66 combined with the capacitor 48 are merely representative of means for preventing operation of the diodes in response to momentary circuit closings of less than a predetermined time; and of means for continuing the display of the time signals after the acceleration-responsive switch has opened.

The preferred embodiment of the invention has been illustrated and described; but some features can be used in different combinations without departing from the invention as defined in the claims.

What is claimed is:

1. An electronic watch including means for illuminating the time display, a battery, and an electric switch that closes to energize the means for illuminating the time display when a display of time is desired, characterized by the switch being constructed and oriented so that it is momentarily closed by the angular acceleration of a manual movement of the watch with the acceleration above a predetermined value, and further characterized by the switch having its various parts balanced and oriented so as to be responsive only to angular acceleration of the watch about an axis generally parallel to the direction of extent of the forearm on which the watch is worn, and further characterized by a band by which the watch is held on the wrist of a person using the watch with a digital face of the watch having the display figures in a row extending in a direction parallel to the direction of extent of the forearm of a person by whom the watch is worn as a wrist watch, the switch being within the watch and having a fixed contact, a movable contact and an inertia element, a movable element to which the movable contact and the inertia element are connected, means supporting the movable element for movement about an axis intermediate the movable contact and the inertia element and generally parallel to the direction of extent of the forearm of a person wearing the watch as a wrist watch so that the operation of the switch is responsive only to angular acceleration about said axis.

2. The electronic watch described in claim 1 characterized by the inertia element having a mass that counterbalances the movable contact on the supporting element so that the movable element, on both sides of its axis, is balanced but moves angularly in response to angular movement of the watch about said axis.

3. An electronic watch including means for illuminating the time display, a battery, and an electric switch that closes to energize the means for illuminating the time display when a display of time is desired, characterized by the switch being constructed and oriented so that it is momentarily closed by the angular acceleration of a manual movement of the watch with the acceleration above a predetermined value, and further characterized by a band by which the watch is held on the wrist of a person using the watch with a digital face of the watch having the display figures in a row extending in a direction parallel to the direction of extent of the forearm of a person by whom the watch is worn as a wrist watch, the switch being within the watch and having a fixed contact, a movable contact and an inertia element, a movable element to which the movable contact and the inertia element are connected, means supporting the movable element for movement about an axis generally parallel to the direction of extent of the forearm of a person wearing the watch and further characterized by the watch having a face on which digital time figures can be viewed by a user of the watch, a manual switch operating element extending through a wall of the watch and movable to close the switch to energize the means for illuminating the time display, the same switch being actuated by the manual switch operating element and by the inertia element at the option of the user of the watch.

4. The electronic watch described in claim 3 further characterized by the inertia element being connected with a movable contact of the switch for closing the switch independently of the manually operated switch element, said manually operated switch element being free of any mechanical connection with the switch but in a position to displace an element of the switch to closed position when said manually operated switch element is moved in a direction to close the switch.

5. An electronic watch including means for illuminating the time display, a battery, and an electric switch that closes to energize the means for illuminating the time display when a display of time is desired, characterized by the switch being constructed and oriented so that it is momentarily closed by the angular acceleration of a manual movement of the watch with the acceleration above a predetermined value, and further characterized by a solid state buffer in a circuit between the battery and a power input connection to the means for illuminating the time display, the operation of said buffer to pass power from the battery to the means for illuminating the time display being controlled by time characteristics of the switch circuit, and further characterized by means in the switch, battery and buffer circuit for preventing supply of power to the means for illuminating time display when the switch closes for a brief period less than a predetermined fraction of a second.

6. The electronic watch described in claim 5 characterized by said means being correlated to prevent supply of power to the means for illuminating the time display when the time of contact of the switch closure is less than about one-hundredth of a second.

7. An electronic watch including means for illuminating the time display, a battery and an electric switch that closes to energize the means for illuminating the time display when a display of time is desired, characterized by the switch being constructed and oriented so that it is momentarily closed by the angular acceleration of a manual movement of the watch with the acceleration above a predetermined value, and further characterized by a solid state buffer in a circuit between the battery and a power input connection to the means for illuminating the time display, the operation of said buffer to pass power from the battery to the means for illuminating the time display being controlled by time characteristics of the switch circuit, and further characterized by means in the switch, battery and buffer circuit for maintaining a supply of power to the means for illuminating the time display for a predetermined time after the switch opens whereby the time display lasts long enough for reliable recognition by a person by whom the watch is used.

8. The electronic watch described in claim 7 further characterized by said means being correlated to maintain the power supply to the means for illuminating the time display for a period of approximately 1 to 4 seconds.

9. An electronic watch including means for illuminating the time display, a battery and an electric switch that closes to energize the means for illuminating the time display when a display of time is desired, characterized by the switch being constructed and oriented so that it is momentarily closed by the angular acceleration of a manual movement of the watch with the acceleration above a predetermined value, and further characterized by a solid state buffer in a circuit between the battery and a power input connection to the means for illuminating the time display, the operation of said buffer to pass power from the battery to the means for illuminating the time display being controlled by time characteristics of the switch circuit, and further characterized by the battery of the watch being in series with a capacitor, a first resistor and an acceleration-sensitive switch, second resistors shunted across the capacitor, a transistor or equivalent with its input circuit shunted across the capacitor and its output circuit connected with the power input circuit of the means for illuminating the time display, the capacitor and the first resistor comprising the means for preventing supply of power to the means for illuminating the time display when the switch closes for a brief period less than a predetermined fraction of a second, and the capacitor and the second resistor comprising the means for maintaining the supply of power to the means for illuminating the time display for a predetermined time after the switch opens.

* * * * *